United States Patent [19]

Coste

[11] 4,333,818

[45] Jun. 8, 1982

[54] SEPARATION OF NORMALLY GASEOUS HYDROCARBONS FROM A CATALYTIC REFORMING EFFLUENT AND RECOVERY OF PURIFIED HYDROGEN

[75] Inventor: Angelo C. Coste, Chicago, Ill.

[73] Assignee: UOP Inc., Des Plaines, Ill.

[21] Appl. No.: 228,516

[22] Filed: Jan. 26, 1981

[51] Int. Cl.[3] ..... C10G 47/00; C10G 49/22

[52] U.S. Cl. ..... 208/101; 208/134; 208/138; 585/655

[58] Field of Search ..... 208/101, 134, 138; 585/655

[56] References Cited

U.S. PATENT DOCUMENTS

| | | | |
|---|---|---|---|
| 3,431,195 | 3/1969 | Storch et al. | 208/101 |
| 3,470,084 | 9/1969 | Scott | 208/101 |
| 3,520,799 | 7/1970 | Forbes | 208/101 |
| 3,520,800 | 7/1970 | Forbes | 208/101 |
| 3,882,014 | 5/1975 | Monday et al. | 208/101 |
| 4,159,937 | 7/1979 | Scott | 208/101 |

*Primary Examiner*—Curtis R. Davis

*Attorney, Agent, or Firm*—James R. Hoatson, Jr.; Robert W. Welch; William H. Page, II

[57] ABSTRACT

A process for the catalytic reforming of a hydrocarbonaceous feedstock, preferably to produce high quality gasoline boiling range products, is disclosed. Relatively impure hydrogen is separated from the reforming zone effluent, compressed, and recontacted with at least a portion of the liquid reformate product to provide relatively pure hydrogen, a portion of which is recycled to the reforming zone. The balance is further compressed and recontacted with at least a portion of the liquid reformate product to provide an improved recovery of normally gaseous hydrocarbons as well as an improved recovery of purified hydrogen at a pressure suitable for use in the relatively high pressure hydrotreating of sulfur-containing feedstocks.

7 Claims, 1 Drawing Figure

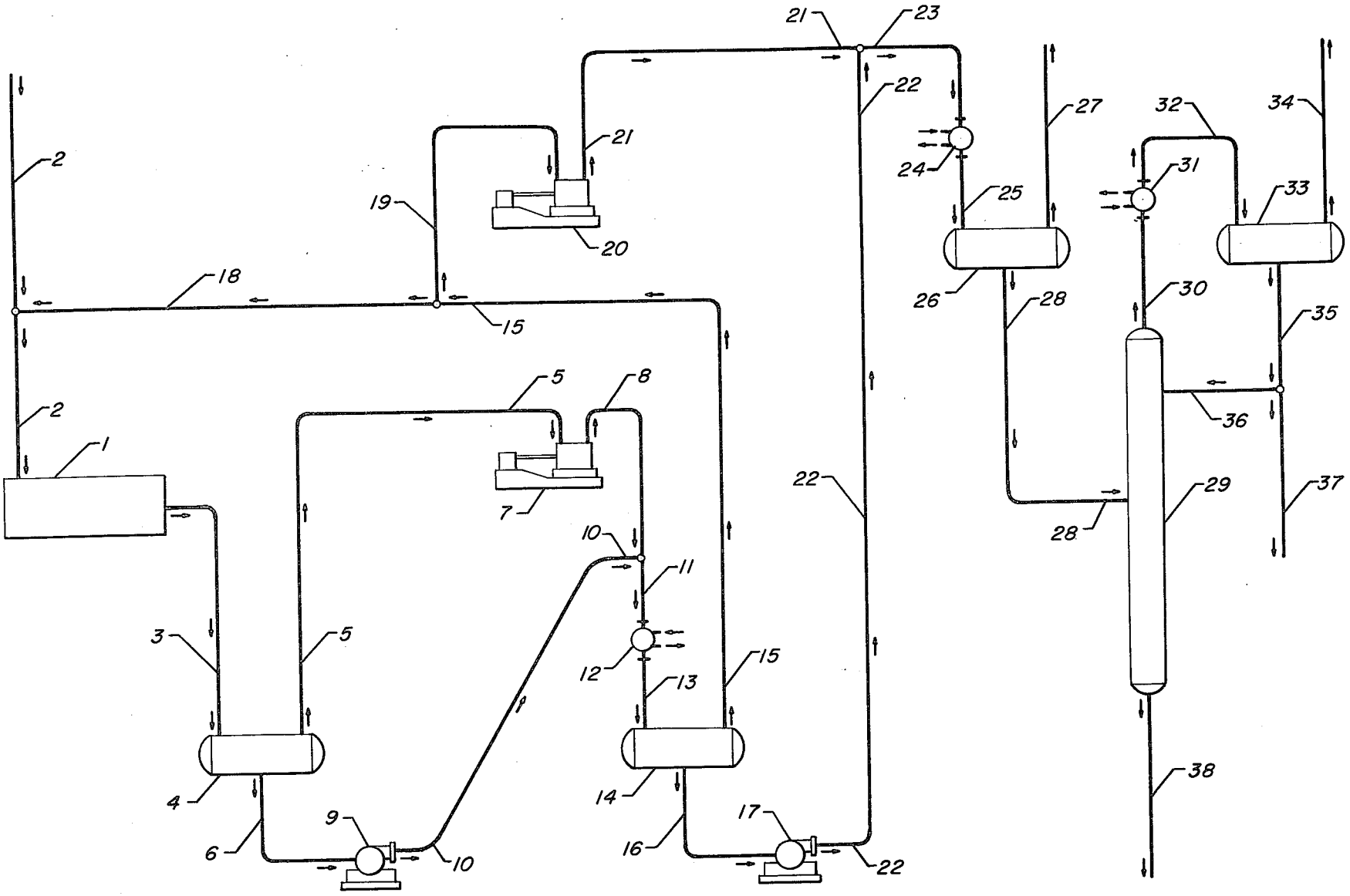
1
2
2
3
4
5
5
6
7
8
9
10
10
11
12
13
14
15
15
16
17
18
19
20
21
21
22
22
22
23
24
25
26
27
28
28
29
30
31
32
33
34
35
36
37
38

SEPARATION OF NORMALLY GASEOUS HYDROCARBONS FROM A CATALYTIC REFORMING EFFLUENT AND RECOVERY OF PURIFIED HYDROGEN

This invention relates to a hydrocarbon conversion process effected in the presence of hydrogen, especially a hydrocarbon conversion process involving dehydrogenation. More particularly, this invention relates to a catalytic reforming process to convert a hydrocarbon feedstock into gasoline boiling range products, and is specifically directed to the recovery of light, normally gaseous hydrocarbons from admixture with the net excess hydrogen from said process.

It is well known that high quality petroleum products in the gasoline boiling range including, for example, aromatic hydrocarbons such as benzene, toluene and the xylenes, are produced by the catalytic reforming process wherein a naphtha fraction is passed in contact with a platinum-containing catalyst in the presence of hydrogen. One of the predominant reactions of the reforming process involves the dehydrogenation of naphthenic hydrocarbons. While a considerable portion of the hydrogen recovered in the effluent from the reforming zone is required for recycle purposes, a substantial net excess of hydrogen is available for other uses, for example, the hydrotreating of sulfur-containing petroleum feedstocks.

However, catalytic reforming also involves a hydrocracking function among the products of which are relatively low molecular weight hydrocarbons including the normally gaseous hydrocarbons such as methane, ethane, propane and the butanes, substantial amounts of which are recovered admixed with the hydrogen separated from the reforming zone effluent. These normally gaseous hydrocarbons have the effect of lowering the hydrogen purity to the extent that purification is required before the hydrogen is suitable for use in other hydrocarbon conversion or treating processes. Aside from a desire to recover high purity hydrogen, it is frequently desirable to maximize the recovery of $C_3$–$C_4$ hydrocarbons to satisfy a demand by other hydrocarbon conversion or organic synthesis processes.

Related prior art schemes involving the separation and recovery of hydrogen generally operate the catalytic reforming zone at a pressure of from about 250 to about 450 psig., with pressures in the lower range being preferred, and the effluent from the reforming zone is separated at a relatively low pressure into a hydrogen-rich gaseous phase and a liquid hydrocarbon phase. The low pressure separation is effected in a gas-liquid separator following the reforming zone, and said separator is operated at substantially the same pressure as the reforming zone allowing for pressure drop through the system. This pressure drop will generally involve from about 50 to about 150 psig. The total hydrogen-rich gaseous phase from the low pressure separator is then compressed and admixed with at least a portion of the liquid hydrocarbon phase from the low pressure separator, and the mixture is subjected to a second gas-liquid separation to yield a gaseous phase relatively rich in hydrogen. This last mentioned gas-liquid separation is at a pressure suitable for recycling at least a portion of the hydrogen-rich gaseous phase to the catalytic reforming zone at the reforming pressure maintained therein, and the balance is available at said pressure as net hydrogen for use, for example, in the hydrotreating of sulfur-containing feedstocks. U.S. Pat. Nos. 3,431,195 and 3,520,799 are representative of the described reforming operation.

The recycled portion of said hydrogen-rich gaseous phase is invariably the greater portion thereof, and the balance, commonly referred to as the net hydrogen, is utilized primarily in the hydrotreating of sulfur-containing feedstocks at a relatively high pressure, say from about 300 to about 800 psig. or more. Prior to utilization in the hydrotreating process, the net hydrogen recovered from the reforming operation must therefore be increased in pressure, particularly when the reforming operation is operated at the preferred low pressures.

It would therefore be desirable to operate the catalytic reforming process so as to produce hydrogen at a pressure suitable for recycle purposes, and so as to produce net hydrogen at a pressure suitable for use in the relatively high pressure hydrotreating of sulfur-containing feedstocks, particularly since this affords an opportunity for the improved production of high purity hydrogen, and for the improved recovery of $C_3$–$C_4$ hydrocarbons during the reforming operation.

Therefore, it is one object of this invention to provide a process for the catalytic reforming of hydrocarbons to produce gasoline boiling range products.

It is another object to provide a catalytic reforming process affording improved production of high purity hydrogen and improved recovery of $C_3$–$C_4$ hydrocarbons.

It is still another object to provide a process for the catalytic reforming of hydrocarbons whereby the net hydrogen is produced at a pressure suitable for use in the high pressure hydrotreating of sulfur-containing feedstocks.

In one of its broad aspects, the present invention embodies a process for the catalytic reforming of hydrocarbonaceous feedstocks which comprises the steps of (a) contacting said feedstock with a reforming catalyst in a reforming zone in the presence of hydrogen at reforming conditions to produce an effluent stream comprising hydrogen admixed with hydrocarbon conversion products; (b) separating said effluent in a first gas-liquid separation zone at a low pressure relative to said reforming zone and forming a gaseous phase comprising hydrogen admixed with light hydrocarbon conversion products and a liquid hydrocarbon phase comprising the heavier hydrocarbon conversion products; (c) compressing the gaseous phase from step (b) to a high pressure relative to said first gas-liquid separation zone; (d) admixing the gaseous phase from step (c) with at least a portion of the liquid hydrocarbon phase from step (b); (e) separating the resulting mixture in a second gas-liquid separation zone at said relatively high pressure and forming a gaseous phase comprising relatively pure hydrogen and a liquid hydrocarbon phase; (f) recycling a portion of the gaseous phase from step (e) to said reforming zone; (g) compressing the balance of the gaseous phase from step (e) to a pressure of from about 300 to about 800 psig.; (h) admixing the gaseous phase from step (g) with at least a portion of the liquid hydrocarbon phase from step (e); (i) separating the resulting mixture in a third gas-liquid separation zone at a pressure of from about 300 to about 800 psig. and forming a purified hydrogen stream and a liquid hydrocarbon stream comprising the hydrocarbon conversion products; (j) recovering the purified hydrogen stream; and, (k) introducing the liquid hydrocarbon stream into a fractionation zone at conditions to produce an overhead fraction comprising light hydrocarbon conversion products and a higher boiling reformate fraction comprising the heavier hydrocarbon conversion products.

Another embodiment of this invention includes the above process wherein said reforming conditions include a pressure of from about 50 to about 250 psig.

A still further embodiment includes the above process wherein said third gas-liquid separation is effected at a temperature of from about 30° to about 50° F.

Other objects and embodiments of this invention will become apparent in the following detailed specification.

The present invention presents a further improvement in the art as set forth above. As will become apparent, the process of this invention provides for the recovery of a purified hydrogen stream from the net excess hydrogen from a hydrocarbon conversion process involving dehydrogenation, and affords a substantial improvement in the recovery of normally gaseous hydrocarbon conversion products therefrom.

The art of catalytic reforming is well known to the petroleum refining industry and does not require detailed description herein. In brief, the catalytic reforming art is largely concerned with the treatment of a petroleum gasoline fraction to improve its anti-knock characteristics. The petroleum fraction may be a full boiling range gasoline fraction having an initial boiling point in the 50°–100° F. range and an end boiling point in the 325°–425° F. range. More frequently, the gasoline fraction will have an initial boiling point in the 150°–250° F. range and an end boiling point in the 350°–425° F. range, this higher boiling fraction being commonly referred to as naphtha. The reforming process is particularly applicable to the treatment of those straight-run gasolines comprising relatively large concentrations of naphthenic and substantially straight-chain paraffinic hydrocarbons which are amenable to aromatization through dehydrogenation and/or cyclization. Various other concomitant reactions also occur, such as isomerization and hydrogen transfer, which are beneficial in upgrading the selected gasoline fraction.

Widely accepted catalysts for use in the reforming process typically comprise platinum on an alumina support. These catalysts will generally contain from about 0.05 to about 5 wt.% platinum. More recently, certain promoters or modifiers, such as cobalt, nickel, rhenium, germanium and tin, have been incorporated into the reforming catalyst to enhance the reforming operation.

Catalytic reforming is a vapor phase operation. Operating conditions include the presence of the hereinabove mentioned catalysts and a pressure of from about 50 to about 1200 psig., preferably from about 50 to about 250 psig. Satisfactory operating conditions further include a temperature of from about 500° to about 1050° F., preferably from about 600° to about 1000° F.; a liquid hourly space velocity of from about 0.2 to about 10; and sufficient hydrogen recycle to provide a hydrogen to hydrocarbon mole ratio in the reforming zone of from about 0.5 to about 15.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor, or the catalyst beds may each be enclosed in a separate reactor in a side-by-side reactor arrangement. Generally, a reaction zone will comprise 2–4 catalyst beds in either the stacked or side-by-side configuration. The amount of catalyst used in each of the catalyst beds may be varied to compensate for the endothermic heat of reaction in each case. For example, in a three catalyst bed system, the first bed will generally contain from about 10 to about 30 vol.%; the second, from about 25 to about 45 vol.%; and the third, from about 40 to about 60 vol.%. With respect to a four catalyst bed system, suitable catalyst loadings would be from about 5 to about 15 vol.% in the first bed, from about 15 to about 25 vol.% in the second, from about 25 to about 35 vol.% in the third, and from about 35 to about 50 vol.% in the fourth.

The reforming operation further includes the separation of a hydrogen-rich vapor phase from the reaction mixture recovered from the reforming zone, at least a portion of which is recycled to the reforming zone. This separation is usually effected at substantially the same pressure as employed in the reforming zone, allowing for pressure drop in the system as heretofore mentioned, and at a temperature of from about 60° to about 120° F. to yield a vapor phase comprising relatively pure hydrogen. A principally liquid phase is further treated in a fractionation column for the recovery of reformed product, commonly referred to as reformate.

The further description of the present invention is presented with reference to the attached schematic drawing. The drawing represents one preferred embodiment of the invention and is not intended as an undue limitation on the generally broad scope of the invention as set out in the appended claims. Miscellaneous hardware such as certain pumps, compressors, condensors, heat exchangers, coolers, valves, instrumentation and controls have been omitted or reduced in number as not essential to a clear understanding of the invention, the utilization of such hardware being well within the purview of one skilled in the art.

In brief description, there is shown a catalytic reforming zone 1, a first gas-liquid separator 4, a second gas-liquid separator 14, a third gas-liquid separator 26, and a stabilizer column 29. The catalytic reforming zone 1 is operated at reforming conditions including a relatively low pressure in the 50–250 psig. range. In view of the large pressure drop through a conventional catalytic reforming zone comprising a plurality of stacked or side-by-side reactors, the reforming pressure referred to herein is intended as the pressure imposed at the top of the initial reactor of said reforming zone. The first gas-liquid separator 4 is maintained at about the same pressure as said reforming zone allowing for a pressure drop of from about 25 to about 50 psig., and at a temperature of from about 60° to about 120° F. The second gas-liquid separator 14 is maintained at said temperature, but at a pressure of from about 75 to about 300 psig. and at least as high as the reforming pressure. The third gas-liquid separator 26 is operated at a pressure of from about 300 to about 800 psig. or more, and at a temperature of from about 0° to about 200° F. Preferably, the third gas-liquid separator is maintained at a pressure of from about 400 to about 600 psig. and at a temperature of from about 30° to about 50° F. Operating conditions for the stabilizer column 29 include a top temperature of from about 170° to about 300° F., a bottoms temperature of from about 300° to about 500° F., and a pressure of from about 250 to about 300 psig.

In a more specific example, a petroleum-derived naphtha fraction is charged to the catalytic reforming zone 1 of the attached drawing, the naphtha fraction being introduced via line 2 in admixture with a recycled hydrogen stream from line 18. A platinum-containing catalyst is contained in the reforming zone which is maintained at reforming conditions including an inlet pressure of about 150 psig. The catalytic reforming zone effluent, at a pressure of about 125 psig., is recovered through line 3 and passed through a cooling means, not shown, to enter the low pressure gas-liquid separator at a temperature of about 115° F., and reduced in pressure to about 110 psig. A vapor phase, comprising about 87 mol.% hydrogen admixed with light ($C_1$–$C_5$) hydrocarbons, is recovered from the first gas-liquid separator 4 by way of an overhead line 5 at a rate of about 35,538.9 mols/hr, and a liquid hydrocarbon phase is recoverd by way of line 6 at a rate of about 4,183.9 mols/hr. The hydrogen-rich stream in line 5 is compressed by means of a compressor 7 and discharged into line 8 at a pressure of about 170 psig. This hydrogen-rich stream is then admixed with the aforementioned liquid hydrocarbon phase from the first gas-liquid separator 4, said liquid hydrocarbon phase having been processed through a pump 9 into line 10 to be admixed with said hydrogen-rich stream from line 8. The resulting mixture is transferred through line 11, a cooling means 12, and line 13 into the second gas-liquid separator 14, said separator being operated at a temperature of about 115° F. and at a pressure of about 165 psig.

The vapor phase that forms in the second gas-liquid separator 14, comprising about 88 mol.% hydrogen, is withdrawn via line 15 at a rate of about 35,722.8 mols/hr, and at said pressure of about 165 psig. The liquid hydrocarbon phase that settles out is recovered through line 16 at a rate of about 4,477.7 mols/hr and routed to a pump 17 to be further utilized as hereinafter described. The first mentioned vapor phase recovered in line 15 is recycled, in part, to the catalytic reforming zone 1. Thus, about 26,595.2 mols/hr, about 75 mol.%, is directed through line 18 to be admixed with the naphtha feedstock as heretofore related. The balance of said vapor phase is diverted through line 19 to a compressor 20 wherein it is increased in pressure to about 500 psig. The compressor effluent in line 21 is admixed with the liquid hydrocarbon phase recovered from the second gas-liquid separator 14 as heretofore stated, said liquid hydrocarbon phase having been discharged from pump 17 into line 22. The mixture is then continued through line 23 to a cooling means 24 wherein the temperature is reduced to about 40° F. The cooled mixture is transferred through line 25 to the third gas-liquid separator 26 wherein a gas-liquid separation is effected at said temperature of about 40° F. and at said pressure of about 500 psig. A purified hydrogen stream, comprising about 93 mol.% hydrogen, is recovered from the third gas-liquid separator 26 via an overhead line 27 at a pressure of about 500 psig., and at a rate of about 8,129.3 mols/hr. This represents about a 99% recovery of the net hydrogen.

The liquid hydrocarbon phase that settles out in the third gas-liquid separator 26 is withdrawn and transferred through line 28 to the stabilizer column 29 at a rate of about 4,998.4 mols/hr, and at a reduced temperature and pressure, that is, about 390° F. and 285 psig. An overhead vapor stream is recovered from the stabilizer column via line 30 at a temperature of about 275° F. and passed through a cooling means 31 to an overhead receiver 33 via line 32. A gaseous phase comprising mainly residual hydrogen, methane, ethane and some higher boiling hydrocarbons is removed from the overhead receiver 33 through line 34 for use, for example, as fuel gas. A liquid hydrocarbon condensate is recovered through line 35, and one portion thereof is recycled through line 36 to the top of the stabilizer column as reflux. The balance is withdrawn by way of line 37 at a rate of about 202.5 mols/hr. This latter stream comprises about 37 mol.% propane and 48 mol.% butanes. The reformate product is recovered from the stabilizer column via line 38 at a rate of about 4,463.8 mols/hr. Said column is operated at a bottoms temperature of about 465° F.

The following data sets forth the composition of certain relevant streams which comprise the process of the above example representing one preferred embodiment of this invention.

| | Line No. | | | | | |
|---|---|---|---|---|---|---|
| Component | 3 | 5 | 10 | 16 | 18 | 19 |
| lb-mols/hr | | | | | | |
| $H_2$ | 31021.4 | 31006.9 | 14.4 | 23.0 | 23390.4 | 7607.7 |
| $C_1$ | 1264.8 | 1260.5 | 4.3 | 6.9 | 949.1 | 308.7 |
| $C_2$ | 1026.5 | 1010.9 | 15.6 | 24.5 | 756.1 | 245.9 |
| $C_3$ | 808.8 | 767.2 | 41.6 | 63.3 | 562.4 | 183.0 |
| $iC_4$ | 245.5 | 218.1 | 27.4 | 40.0 | 155.0 | 50.4 |
| $nC_4$ | 334.3 | 285.5 | 48.8 | 70.0 | 199.4 | 64.9 |
| $iC_5$ | 217.3 | 154.8 | 62.5 | 83.2 | 101.2 | 32.9 |
| $nC_5$ | 134.2 | 88.6 | 45.6 | 59.2 | 56.5 | 18.4 |
| $C_6$+ | 4670.1 | 746.4 | 1923.9 | 4107.6 | 424.1 | 138.0 |
| Total | 39722.9 | 35538.9 | 4183.9 | 4477.7 | 26595.2 | 8649.9 |
| Lbs/hr | 664,939 | 257,761 | 407,178 | 428,890 | 178,118 | 57,932 |
| Mol. Wt. | 16.7 | 7.3 | 97.3 | 95.8 | 6.7 | 6.7 |
| B.p.s.d. | 0.0 | 0.0 | 33701.8 | 35899.7 | 0.0 | 0.0 |
| $10^6$ s.c.f.b. | 0.0 | 323.7 | 0.0 | 0.0 | 242.2 | 78.9 |

| | Line No. | | | | | |
|---|---|---|---|---|---|---|
| Component | 23 | 27 | 28 | 34 | 37 | 38 |
| lb-mols/hr | | | | | | |
| $H_2$ | 7630.7 | 7564.6 | 66.1 | 65.5 | 0.6 | — |
| $C_1$ | 315.6 | 286.0 | 29.6 | 27.6 | 2.0 | — |
| $C_2$ | 270.4 | 171.1 | 99.3 | 76.6 | 22.7 | — |
| $C_3$ | 246.2 | 69.8 | 176.4 | 100.9 | 75.6 | — |
| $iC_4$ | 90.5 | 11.4 | 79.1 | 32.6 | 46.5 | — |
| $nC_4$ | 134.9 | 11.7 | 123.2 | 27.5 | 51.1 | 44.6 |
| $iC_5$ | 116.2 | 3.8 | 112.2 | 1.1 | 4.0 | 107.1 |
| $nC_5$ | 77.6 | 1.9 | 75.7 | — | — | 75.7 |
| $C_6$+ | 4245.5 | 9.0 | 4236.8 | — | — | 4236.4 |
| Total | 13127.6 | 8129.3 | 4998.4 | 331.8 | 202.5 | 4463.8 |
| Lbs/hr | 486,822 | 30,564 | 456,258 | 10,706 | 10,010 | 435,321 |
| Mol. Wt. | 37.1 | 3.8 | 91.3 | 35.2 | 49.4 | 97.5 |
| B.p.s.d. | — | — | 39143.1 | — | 1282.0 | 36258.3 |
| $10^6$ s.c.f.b. | — | 74.0 | — | 2.8 | — | — |

Therefore, from the detailed description presented above, the preferred embodiment of this invention provides an improvement in a process for the catalytic reforming of a naphtha feedstock which comprises the steps of (a) contacting said feedstock with a platinum-containing reforming catalyst in a reforming zone in the presence of hydrogen at reforming conditions, including a pressure of from about 50 to about 250 psig., to provide an effluent stream comprising hydrogen admixed with hydrocarbon conversion products; (b) separating said effluent in a first gas-liquid separation zone at a temperature of from about 60° to about 120° F. and at a pressure which is from about 25 to about 50 psig. lower than said reforming pressure, and forming a gaseous phase comprising hydrogen admixed with light hydrocarbon conversion products and a liquid hydrocarbon phase comprising the heavier hydrocarbon conversion products; (c) compressing the gaseous phase from step (b) to a pressure of from about 75 to about 300 psig. and at least as high as said reforming pressure; (d) admixing the gaseous phase from step (c) with at least a portion of the liquid hydrocarbon phase from step (b); (e) separating the resulting mixture in a second gas-liquid separation zone at said pressure and at a temperature of from about 60° to about 120° F., and forming a gaseous phase comprising relatively pure hydrogen and a liquid hydrocarbon phase; (f) recycling a portion of the gaseous phase from step (e) to said reforming zone; (g) compressing the balance of the gaseous phase from step (e) to a pressure of from about 300 to about 800 psig.; (h) admixing the gaseous phase from step (g) with at least a portion of the liquid hydrocarbon phase from step (e); (i) separating the resulting mixture in a third gas-liquid separation zone at said pressure of from about 300 to about 800 psig. and at a temperature of from about 30° to about 50° F., and forming a purified hydrogen stream and a liquid hydrocarbon stream comprising hydrocarbon conversion products; (j) recovering the purified hydrogen stream; and, (k) introducing the liquid hydrocarbon stream into a fractionation zone at conditions to produce an overhead fraction comprising a $C_3$–$C_4$ hydrocarbon product and a higher boiling reformate fraction comprising $C_6$+ hydrocarbon conversion products.

I claim as my invention:

1. A process for the catalytic reforming of a hydrocarbonaceous feedstock which comprises the steps of:

(a) contacting said feedstock with a reforming catalyst in a reforming zone in the presence of hydrogen at reforming conditions to produce an effluent stream comprising hydrogen admixed with hydrocarbon conversion products;

(b) separating said effluent in a first gas-liquid separation zone at a low pressure relative to said reforming zone and forming a gaseous phase comprising hydrogen admixed with light hydrocarbon conversion products and a liquid hydrocarbon phase comprising the heavier hydrocarbon conversion products;

(c) compressing the gaseous phase from step (b) to a high pressure relative to said first gas-liquid separation zone;

(d) admixing the gaseous phase from step (c) with at least a portion of the liquid hydrocarbon phase from step (b);

(e) separating the resulting mixture in a second gas-liquid separation zone at said relatively high pressure and forming a gaseous phase comprising relatively pure hydrogen and a liquid hydrocarbon phase;

(f) recycling a portion of the gaseous phase from step (e) to said reforming zone;

(g) compressing the balance of the gaseous phase from step (e) to a pressure of from about 300 to about 800 psig.;

(h) admixing the gaseous phase from step (g) with at least a portion of the liquid hydrocarbon phase from step (e);

(i) separating the resulting mixture in a third gas-liquid separation zone at a pressure of from about 300 to about 800 psig. and forming a purified hydrogen stream and a liquid hydrocarbon stream comprising the hydrocarbon conversion products;

(j) recovering the purified hydrogen stream; and, (k) introducing the liquid hydrocarbon stream into a fractionation zone at conditions to produce an overhead fraction comprising light hydrocarbon conversion products and a higher boiling reformate fraction comprising the heavier hydrocarbon conversion products.

2. The process of claim 1 further characterized with respect to step (a) in that said reforming conditions include a pressure of from about 50 to about 250 psig.

3. The process of claim 1 further characterized with respect to step (b) in that said relatively low pressure is from about 25 to about 50 psig. lower than the reforming pressure.

4. The process of claim 1 further characterized with respect to step (c) in that said relatively high pressure is at least as high as the pressure maintained in said reforming zone.

5. The process of claim 1 further characterized with respect to step (c) in that said relatively high pressure is from about 75 to about 300 psig. and at least as high as the pressure maintained in said reforming zone.

6. The process of claim 1 further characterized in that said first and said second gas-liquid separation zones are maintained at a temperature of from about 60° to about 120° F.

7. The process of claim 1 further characterized with respect to step (i) in that said gas-liquid separation is effected at a temperature of from about 30° to about 50° F.

* * * * *